US005213024A

United States Patent [19]

Huber et al.

[11] Patent Number: 5,213,024

[45] Date of Patent: May 25, 1993

[54] DAMPING MECHANISM FOR CYLINDER/PISTON MECHANISM

[75] Inventors: Gerhard Huber, Frankenhofen; Bernhard Hollerbach, Steingaden, both of Fed. Rep. of Germany

[73] Assignee: Hoerbiger Fluidtechnik Gmbh, Schongau, Fed. Rep. of Germany

[21] Appl. No.: 853,244

[22] Filed: Mar. 18, 1992

[30] Foreign Application Priority Data

Mar. 25, 1991 [AT] Austria ..... 649/91

[51] Int. Cl.[5] ..... F01B 11/02

[52] U.S. Cl. ..... 92/85 R; 92/165 R

[58] Field of Search ..... 92/85 R, 85 A, 165 R, 92/168

[56] References Cited

U.S. PATENT DOCUMENTS

| | | | |
|---|---|---|---|
| 927,940 | 7/1909 | Brothers | 92/85 R |
| 2,928,094 | 3/1960 | Crooks et al. | 92/85 R |
| 3,010,430 | 11/1961 | Allen et al. | 92/85 R |
| 3,143,181 | 8/1964 | Bays et al. | 92/85 R |
| 3,236,223 | 2/1966 | Rockwood | 92/85 R |
| 3,273,469 | 9/1966 | Doyle | 92/85 R |
| 4,838,393 | 6/1989 | Mourray et al. . | |

FOREIGN PATENT DOCUMENTS

| | | |
|---|---|---|
| 2150871 | 6/1972 | Fed. Rep. of Germany . |
| 1401126 | 7/1975 | United Kingdom . |

*Primary Examiner*—Thomas E. Denion

*Attorney, Agent, or Firm*—Watson, Cole, Grindle & Watson

[57] ABSTRACT

A damping mechanism for decelerating the movement of a piston of a cylinder/piston mechanism includes at least one elastically deformable damping element, which in the installed state is disposed undetachably between two holding regions which are spaced apart in the direction of the piston movement and wherein one holding region communicates with the cylinder and the other holding region communicates with the piston during deceleration.

12 Claims, 1 Drawing Sheet

DAMPING MECHANISM FOR CYLINDER/PISTON MECHANISM

BACKGROUND OF THE INVENTION

1. Field of the Invention

The invention relates to a cylinder/piston mechanism, in which the piston can be displaced by means of the working medium in the cylinder, and at least one damping arrangement, which is active in the region of one of the final positions of the piston, to decelerate the piston movement.

2. Related Art

For hydraulic or pneumatic cylinder/piston mechanisms, which are also simply called working cylinders, damping mechanisms of the aforementioned type are used to avoid a sudden impact upon reaching the final position of the piston. They are necessary in any event, when, during the stroke of the piston, relatively rapidly moving masses are to be slowed without any jolt before reaching the final position. In this connection, current damping arrangements are customary in which the movement of the piston in the region of the final position is delayed by throttling the discharging working medium. To that end, there are separate throttling members or suitable dead volume spaces, from which an immersing region of the piston squeezes out the working medium, a feature that in both cases causes problems especially for small cylinder/piston mechanisms and the resulting small volumetric flows and increases in any case the complexity of the design, since a throttling of the discharging volumetric flow is difficult to realize and increases and complicates the manufacture as a consequence of the relatively high accuracy required for a defined damping in the region of the restrictors.

SUMMARY OF THE INVENTION

A primary object of the present invention is to improve a mechanism of the aforementioned kind in such a manner that the stated drawbacks of such known mechanisms are avoided. In particular, for small cylinder/piston mechanisms a simply constructed and reliably acting damping arrangement for the final position damping is enabled.

This problem with a mechanism of the aforementioned kind is solved with the present invention in that the damping arrangement includes at least one elastically deformable damping element, which in the installed state is disposed undetachably between two holding regions, which are spaced apart in the direction of the piston movement and of which the one communicates with the cylinder and the other with the piston during deceleration. Thus, the final position damping is uncoupled from the working medium or from the throttling of the discharge of the working medium in the final region of the piston movement. The restrictors or damping volume spaces, or the like, that are super-proportionally complicated, especially for small cylinder/-piston mechanisms can be dispensed with, since now the damping takes place by means of the elastically deformable damping element, which interacts in the two holding regions with the piston, on the one hand, and the cylinder on the other hand, to decelerate the piston movement.

According to an especially preferred embodiment of the invention there are communicating between the holding regions, on the one hand, with the cylinder and, on the other hand, with the piston during the deceleration with other holding regions, which are disposed on retaining elements that can be displaced opposite the cylinder and the piston in the direction of the piston movement, as well as damping elements held undetachably in between in the installed state. This corresponds to a series connection of damping elements, a feature that enables to a large extent arbitrary extensions of the damping distance or very extensive effects on the damping characteristic. Apart from identical damping elements in arrangement and design, different damping elements can also be used, of course, that deviate in arrangement and/or design.

According to a preferred embodiment of the invention, substantially inelastic spacers, which limit the elastic compression of the damping element, are provided between every two holding regions facing a damping element. Thus, the result on the actual end of the piston movement is a mechanical stop for the components within the holding regions, thus reliably preventing the damping elements from being damaged or destroyed during continuous loading.

According to another preferred embodiment of the invention, the holding regions are designed in essence annularly and lie together with the damping element(s) that is/are also designed in essence annularly concentrically to the axis of the cylinder/piston mechanism. This enables a simple manufacture of the holding regions and the damping elements and ensures a uniform deceleration of the piston movement around the axis of the working cylinder, so that no oscillations or the like will occur.

Another simplification of the design of the invention is enabled with another embodiment in that each damping element is designed as a ring with a substantially circular cross section, preferably as an O-ring. Such components are very simple to manufacture or—as in the case of the O-ring—can be obtained inexpensively in graduated standard sizes, so that the damping arrangement becomes on the whole very inexpensive.

According to another preferred design of the invention, the holding regions can exhibit a contour that partially envelopes on one side in a shape-locking manner the damping element in the installed, unloaded state. This is a feature that guarantees a reliable retention, especially in connection with the aforementioned design of the damping element as an O-ring.

According to another preferred design of the invention, the force/path characteristic of the damping element can be adjusted by selecting the elasticity of the damping element(s) and/or the contour of the holding regions. Since the contact surface between the holding region and the damping element is expanded with the advancing compression of the damping element during the deceleration of the piston, the force/path characteristic of the damping can be affected directly, for example, through a specifically chosen curvature of the possible contact region.

According to another design of the invention, the holding regions are retaining rings, which are disposed concentrically with respect to a piston rod bearing the piston and which in the installed, unloaded state are fixed together with the damping elements(s) either relative to the piston rod or relative to the cylinder. Thus, the entire damping arrangement is disposed as a compact unit, for example, on one or both ends of the cylinder in a concentrically expanded bore. The piston or a component connected to said piston by means of the piston rod makes contact with this damping arrangement only in the region of the final position to be damped and causes the described compression of the damping elements.

Apart from the described ring shape, the damping elements can also exhibit any other arbitrary suitable shape; a spherical or cylindrical shape is mentioned only as an exemplary embodiment. With respect to the targeted damping characteristic, the holding regions must be adapted to the shape of the damping elements. Even the attachment of the entire damping arrangement or its individual parts can be varied widely and adapted to the concrete peculiarities of a specific cylinder/piston mechanism. Thus, for example, two substantially disk-like holding elements with an intermediary damping element and suitable connecting elements can be mounted simply on the face of the piston and interact with the inner cylinder end to decelerate the inserted final position of the piston. In addition to this, it is also possible to attach the damping arrangement outside the cylinder, where it interacts, for example, stationary with a collar or other stop member on the piston rod.

BRIEF DESCRIPTION OF THE DRAWINGS

The above objects, features and advantages of the invention are believed to be readily apparent from the following description of a preferred embodiment of the best mode of carrying out the invention, when taken in conjunction with the drawings, wherein.

DETAILED DESCRIPTION OF A PREFERRED EMBODIMENT

Figure 1:
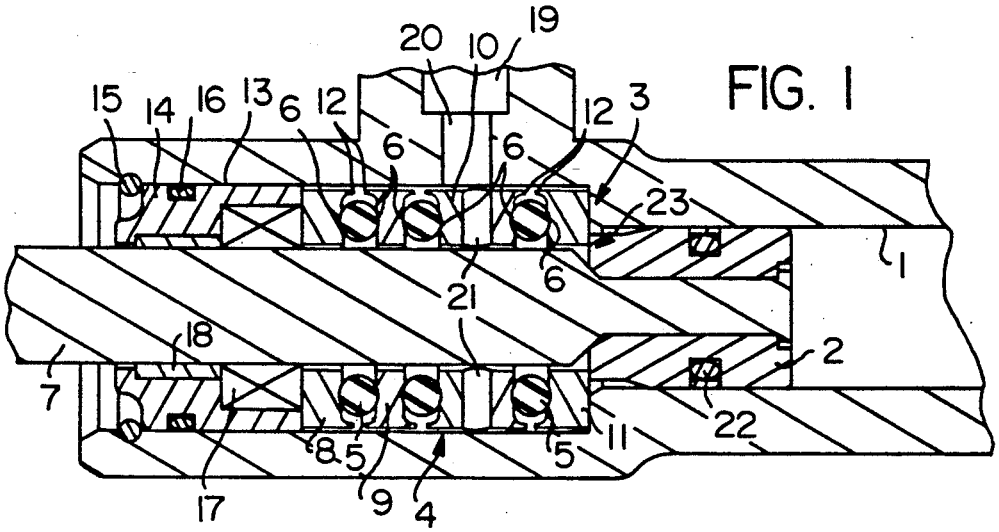
FIG. 1 is a partial sectional view of a cylinder/piston arrangement according to the invention in the region of the damping arrangement shortly before start of the damping.

The cylinder/position mechanism of FIG. 1 shows piston 2, which can be displaced in cylinder 1 by means of the forking medium, and a damping arrangement 4, effective int he region of one of the final positions 3 of piston 2, to unilaterally decelerate the piston movement. The damping arrangement 4 in the illustrated example comprises elastically deformable damping elements 5, which are designed as rings with a circular cross section, for example as O-rings. In the illustrated installed state the individual damping elements 5 are disposed undetachably between two hiding regions 6, each spaced apart in the direction of the piston movement and that are designed on retaining rings 8, 9, 10 and 11 arranged concentrically with respect to a piston rod 7 bearing piston 2. Between two holding regions 6, each facing a damping element 5, there are provided non-elastic spacers 12, which limit the elastic compression of the damping element 5 and are designed in the shape of a raised edge running on the outside of the retaining rings.

The entire damping mechanism 4 is disposed on the illustrated end of cylinder 1 in concentrically expanded bore 13 and held in such a manner by means of a cover 14 that the holding regions 6 rest on the damping elements 5 and thus undetachably hold the damping elements in the illustrate position. It is immaterial whether the damping elements 5 are already more or less prestressed.

The cover 14 is fixed with a retaining ring 15 in the bore 13 and sealed by means of a seal 16 on the outer circumference of the bore. On the inside the cover 14 bears, on the other hand, a sealing set 17 in order to seal against the piston rod 7 and, on the other hand, a sleeve 18 to guide the piston rod.

From the connection 19, which is only indicated, for the working medium, bore 20 leads to the region of the working chamber, which receives the damping mechanism 4, in the cylinder 1, where the cross bores 21 on the central retaining ring 10 enable or facilitates the inflow and outflow of the working medium.

Figure 2:
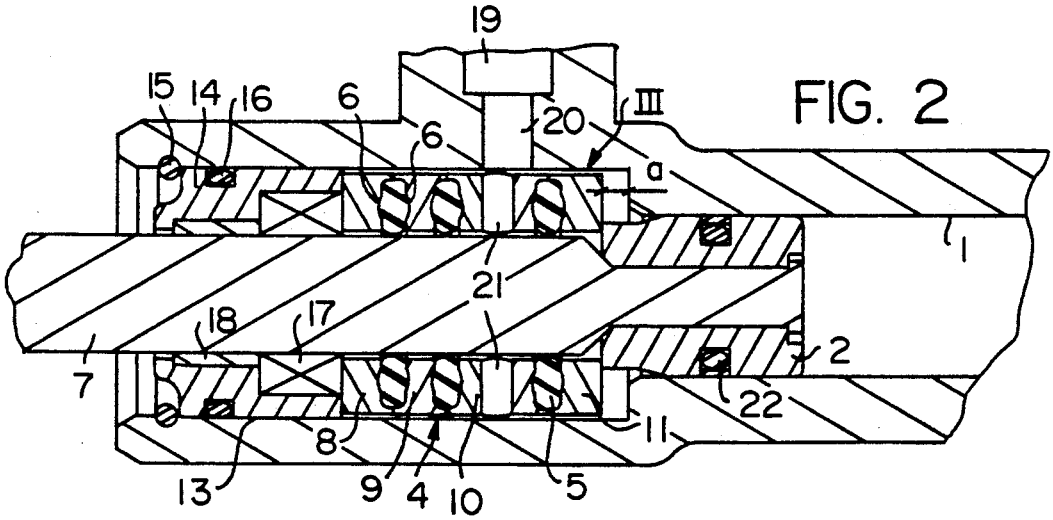
FIG. 2 is an identical view of the arrangement according to FIG. 1 at the end of damping.
Figure 3:
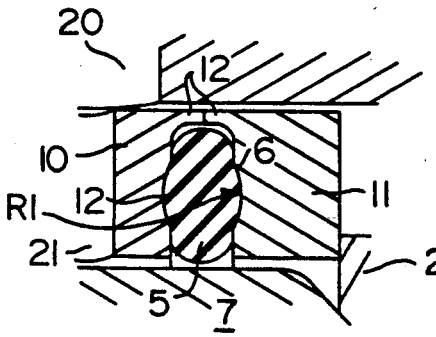
FIG. 3 shows a detail from FIG. 2 on an enlarged scale.

The damping mechanism 4 and the above described individual parts thereof remain in the relaxed position, as shown in FIG. 1, until the piston rod-sided and 23 of the piston 2—whose sealing in the cylinder 1 is denoted as 22—makes contact with the retaining ring 11, as is apparent from a consideration of FIG. 1. Starting from this instant, the additional outward movement of the piston 2 results in a largely simultaneous compression of the damping elements 5 that are connected in series and that deform into the cross section apparent from FIGS. 2 and 3, pressing flat the original annular cross section. This continues until the spacers 12 come to rest, as is apparent from FIG. 3, thus preventing the damping elements 5 from being destroyed during continuous loading. The holding regions 6 are designed in such a manner, as best shown in FIG. 3, that the damping elements remain undetachably in their radial position and thus neither rub on the piston rod 7 nor can be pinched and destroyed by the raised edge forming the respective spacers 12. The O-rings forming the damping elements 5 here are embedded substantially into a groove with the radius R1 (FIG 3) in the unloaded state of the damping mechanism, where the size of this radium corresponds to the cross sectional radium of the O-ring.

It is also readily apparent from FIG. 3 that through a suitable choice of the hardness of the damping elements and the contour of the holding regions 12, an accurate force/path characteristic can be set that in turn can be tuned to the load to be decelerated an the speed of the piston. The damping path (a in FIG. 2) can be varied in the simplest manner by means of the dimension of the damping elements 5, on the one hand, and the number of damping elements connected in series, on the other hand.

The above-described embodiments have been made solely for the purpose of describing the invention and it is understood that the scope of the invention is to be determined by the appended claims, and in particular the equivalents to be afforded the elements of the claims.

What is claimed is:

1. A damping mechanism for a cylinder/piston mechanism, comprising:

a cylinder including a working medium and a plurality of holding assemblies each including two holding members spaced along the longitudinal axis of said cylinder and each said holding assembly including an elastically deformable damping element positioned between said two spaced holding members, said cylinder further including a substantially inelastic spacer for limiting the elastic compression of said damping element and located between said two holding members in each said plurality of holding assemblies and facing the damping element therein;

a piston displaceable along the longitudinal axis of said cylinder by means of said working medium and being decelerated by said plurality of holding assemblies;

each of said holding assemblies being positioned between the inner wall of said cylinder and a surface of said piston, each of said two holding members in each of said plurality of holding assemblies being contoured for shape-locking the retained damping element in an unloaded condition; and a force/path characteristic of the damping mechanism is adjusted by selecting the elasticity of said damping elements or the contour of the holding members.

2. A damping mechanism as claimed in claim 1, wherein said cylinder further includes elements displaced along the longitudinal axis of the cylinder and the piston in the direction of the piston movement for retaining said plurality of holding assemblies.

3. A damping mechanism as claimed in claim 1, wherein each of the plurality of two holding members are essentially annularly-shaped and lie together with the associated damping elements and said damping elements are essentially annularly-shaped and located concentrically to the axis of the cylinder/piston mechanism.

4. A damping mechanism as claimed in claim 2, wherein each of the plurality of two holding members are essentially annularly-shaped and lie together with the associated damping elements and said damping elements are essentially annularly-shaped and located concentrically to the axis of the cylinder/piston mechanism.

5. A damping mechanism as claimed in claim 1, wherein each of said damping elements is a ring with a substantially circular cross section.

6. A damping mechanism as claimed in claim 2, wherein each of said damping elements is a ring with a substantially circular cross section.

7. A damping mechanism as claimed in claim 3, wherein each of said damping elements is a ring with a substantially circular cross section.

8. A damping mechanism as claimed in claim 2, wherein the force/path characteristic of the damping mechanism is adjusted by selecting the elasticity of said damping elements or the contour of each of the holding members in each of said holding assemblies.

9. A damping mechanism as claimed in claim 1, wherein the holding assemblies comprise retaining rings disposed concentrically to the piston rod bearing the piston and which in the installed, unloaded state are fixed together with the damping elements either relative to the piston rod or the cylinder.

10. A damping mechanism as claimed in claim 3, wherein each of said plurality of holding assemblies comprise a retaining ring disposed concentrically to a piston rod bearing the piston and which in the installed, unloaded state are fixed together with the damping elements either relative to the piston rod and the cylinder.

11. A damping mechanism as claimed in claim 4, wherein each of said plurality of holding assemblies comprise a retaining ring disposed concentrically to a piston rod bearing the piston and which in the installed, unloaded state are fixed together with the damping elements either relative to the piston rod or the cylinder.

12. A damping mechanism as claimed in claim 1, wherein each of said plurality of holding assemblies comprise a retaining ring disposed concentrically to a piston rod bearing the piston and which in the installed, unloaded state are fixed together with the damping elements either relative to the piston rod or the cylinder.

* * * * *